US008430589B2

(12) United States Patent
Schneider

(10) Patent No.: US 8,430,589 B2
(45) Date of Patent: Apr. 30, 2013

(54) ORAL HYGIENE TOOL FOR EXTRUDING A DENTIFRICE

(76) Inventor: Robert M. Schneider, Tannersville, NY (US)

( * ) Notice: Subject to any disclaimer, the term of this patent is extended or adjusted under 35 U.S.C. 154(b) by 1270 days.

(21) Appl. No.: 12/188,312

(22) Filed: Aug. 8, 2008

(65) Prior Publication Data

US 2009/0044354 A1 Feb. 19, 2009

Related U.S. Application Data

(60) Provisional application No. 60/964,977, filed on Aug. 16, 2007.

(51) Int. Cl.
*B43K 5/06* (2006.01)

(52) U.S. Cl.
USPC ..... 401/175; 401/276; 401/277; 401/288

(58) Field of Classification Search ..... 401/171–175, 401/276, 277, 288–290
See application file for complete search history.

(56) References Cited

U.S. PATENT DOCUMENTS

| | | | | |
|---|---|---|---|---|
| 1,114,646 | A * | 10/1914 | Pap | 401/175 |
| 4,199,270 | A * | 4/1980 | Tomasini | 401/277 |
| 4,201,490 | A * | 5/1980 | D'Angelo | 401/175 |
| 5,304,009 | A | 4/1994 | Marshall | |
| 5,309,590 | A | 5/1994 | Guiliani et al. | |
| 5,348,028 | A | 9/1994 | Gustavel | |
| 6,290,417 | B1 | 9/2001 | Kaminski | |

OTHER PUBLICATIONS

International Search Report and Written Opinion mailed Jan. 12, 2009 for PCT Application No. PCT/US2008/072599.

* cited by examiner

*Primary Examiner* — Tuan N Nguyen
(74) *Attorney, Agent, or Firm* — Moser Taboada

(57) ABSTRACT

An oral hygiene tool comprises a tubular body comprising a main body tube having a first locking means, a brush section having multiple bristles and a first opening, and an end cap having a threaded pole, a turn cap and a second locking means to mate with the first locking means, to provide a lock there between. The main body tube is configured for storing a dentifrice. The tool further includes an internally threaded bob to mate with the threaded pole. The end cap is assembled with the tubular body by locking the first and the second locking means. Turning the turn cap causes the bob to move in a direction along the threaded pole causing the dentifrice to be released from the first opening.

12 Claims, 8 Drawing Sheets

ORAL HYGIENE TOOL FOR EXTRUDING A DENTIFRICE

CROSS-REFERENCE TO RELATED APPLICATIONS

This application claims benefit of U.S. provisional patent application Ser. No. 60/964,977, filed Aug. 16, 2007, which is herein incorporated by reference.

FIELD OF THE INVENTION

The present invention relates to an oral hygiene tool and more specifically, to oral hygiene tools such as toothbrushes that extrudes a dentifrice.

BACKGROUND

An oral hygiene tools such as a toothbrushes are used for cleaning teeth in conjunction with a dentifrice, for example, tooth paste, and the like. Toothbrush design have been subject of various changes, which include mechanized toothbrushes, battery powered toothbrushes among various other. Further, the combination of a toothbrush with a dentifrice has also been a desirable feature for the convenience it provides by eliminating the need for a separate toothbrush containment.

According to one conventional solution, a replaceable toothpaste-dispensing toothbrush is designed to combine a toothbrush with housing for toothpaste. This design works on a complex spring-loaded snapping mechanism, which uses complex parts like springs. A toothpaste cartridge is further required to be loaded, and needs a piston driven dispensing mechanism for cartridge loading. In addition to the complexity of various mechanisms, such tools further require a toothpaste injector to seal the unused toothpaste.

Another such conventional technique discloses a toothbrush having an elongated housing structure for accommodating a toothbrush head at one end, and insertion for accommodating a toothpaste tube at its other end. In use, such devices generally need a tedious process of first loading the toothpaste tube and then discharging the toothpaste using a complex mechanism.

Accordingly there exists a need for an oral hygiene tool that provides a simple device for storing a dentifrice and releasing the dentifrice using a simple mechanism.

SUMMARY

According to an aspect, the present invention provides an oral hygiene tool comprises a tubular body comprising a main body tube having a first locking means, a brush section having multiple bristles and a first opening, and an end cap having a threaded pole, a turn cap and a second locking means to mate with the first locking means, to provide a lock there between. The main body tube is configured for storing a dentifrice. The tool further includes an internally threaded bob to mate with the threaded pole. The end cap is assembled with the tubular body by locking the first and the second locking means. Turning the turn cap causes the bob to move in a direction along the threaded pole causing the dentifrice to be released from the first opening.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale.

Figure 1:
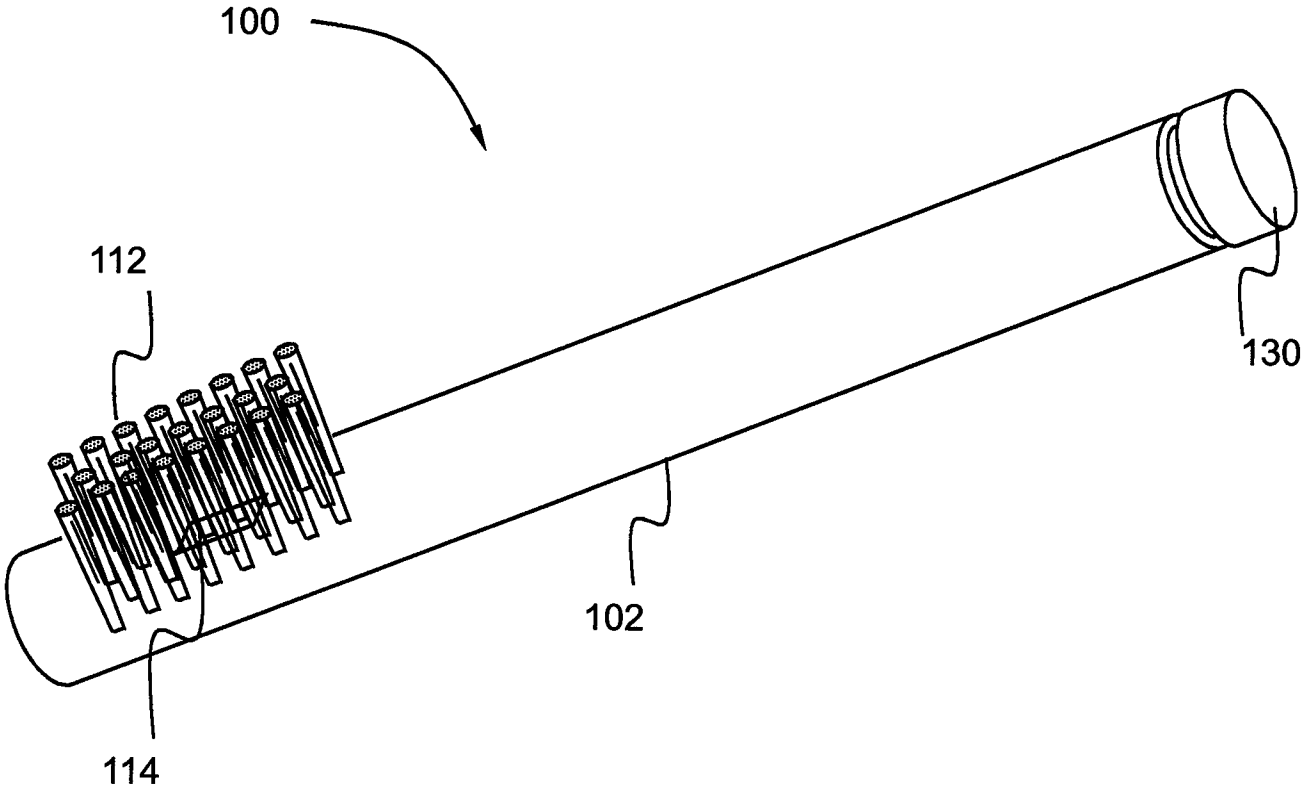
FIG. 1 is a perspective view of an oral hygiene tool according to an aspect of the present invention.
Figure 2:
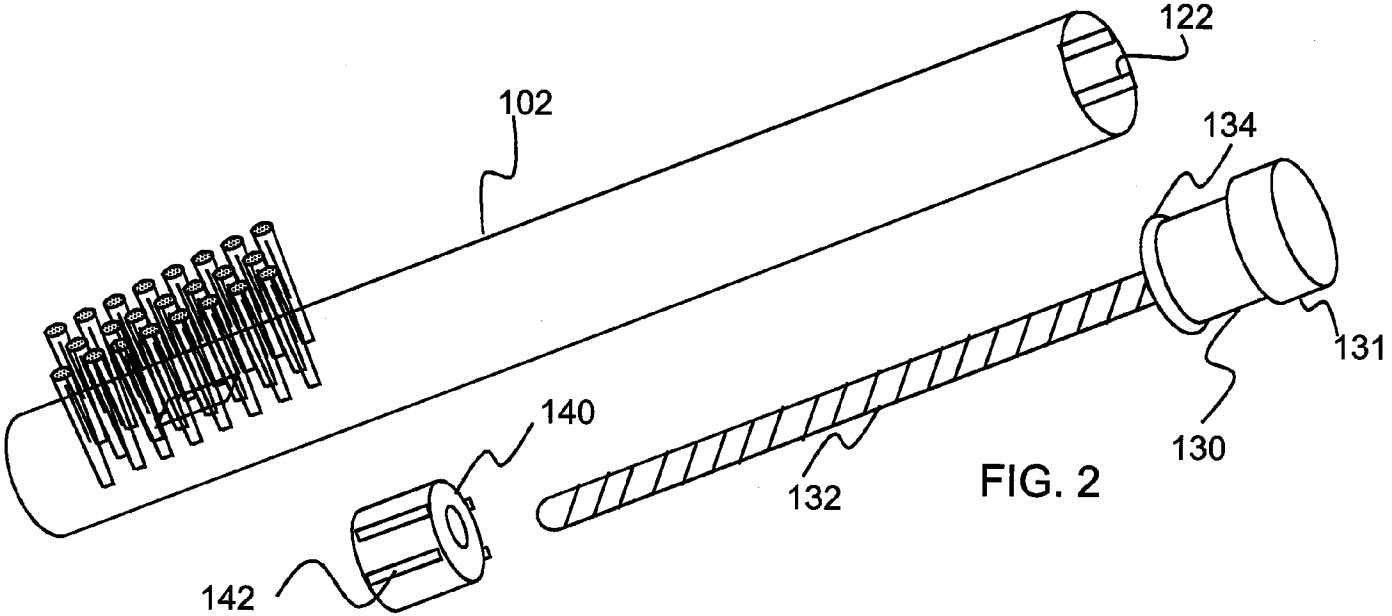
FIG. 2 is a perspective view of certain components of the tool of FIG. 1.
Figure 3:
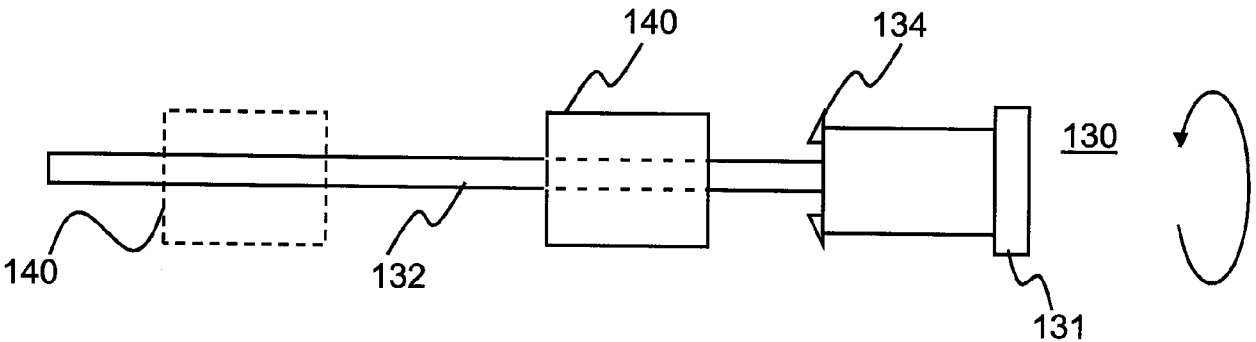
FIG. 3 is a side view of an end cap of the tool of FIG. 1.

While the invention is described herein by way of example using several embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modification, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned.

DETAILED DESCRIPTION

FIGS. 1 to 6 illustrate an oral hygiene tool, for example, a toothbrush 100, in accordance with various aspects of the present invention. The toothbrush 100 includes a tubular body 102 having a brush section 110, a main body tube 120. The toothbrush 100 further includes an end cap 130 and an internally threaded bob 140 (shown in FIG. 2). The brush section 110 has multiple bristles 112, and a first opening 114. The main body tube 120 has an inner wall 125, an outer wall 127, an open proximal end 123, a distal end 121 and a first locking means 124. In certain embodiments as also illustrated by the figures, the main body tube 120 has one or more rails 122, shaped, for example, like a protrusion out of the inner wall 125. The end cap 130 includes a threaded pole 132 and a turn cap 131 rigidly coupled to the threaded pole 132. A second locking means 134 is positioned on the turn cap 131. The second locking means is configured to mate with the first locking means 124 to provide a locking configuration. An internally threaded bob 140 is configured to mate with the threaded pole 132. The bob 140 has a shape configured to fit within the space of the main body tube 120. Further, according to certain embodiments, the bob 140 has one or more conformal mating means 142 having a shape of, for example, indentations, to mate with the rails 122. The rails 122 are configured to guide the movement of the bob 140 within the main body tube 120.

Figure 5:
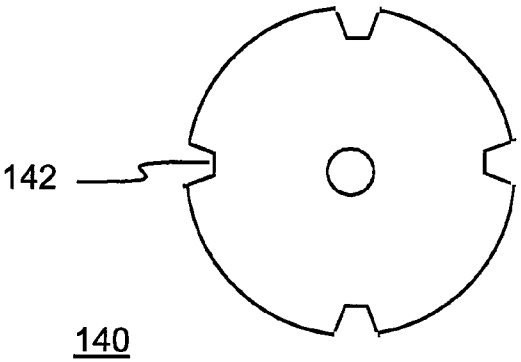
FIG. 5 is a cross section view of the bob of the tool of FIG. 1.
Figure 4:
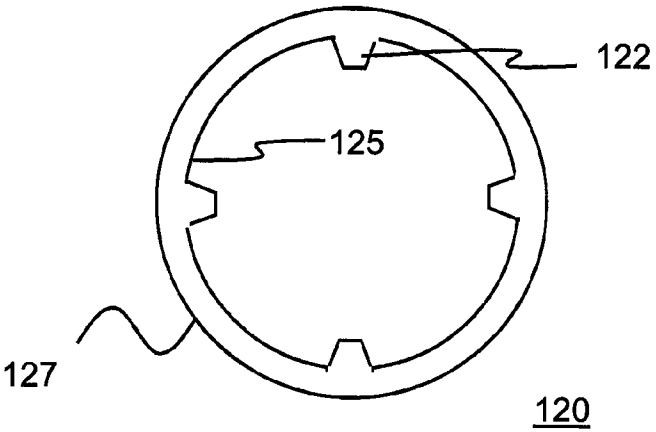
FIG. 4 is a cross section view of a main body tube of the tool of FIG. 1.
Figure 6:
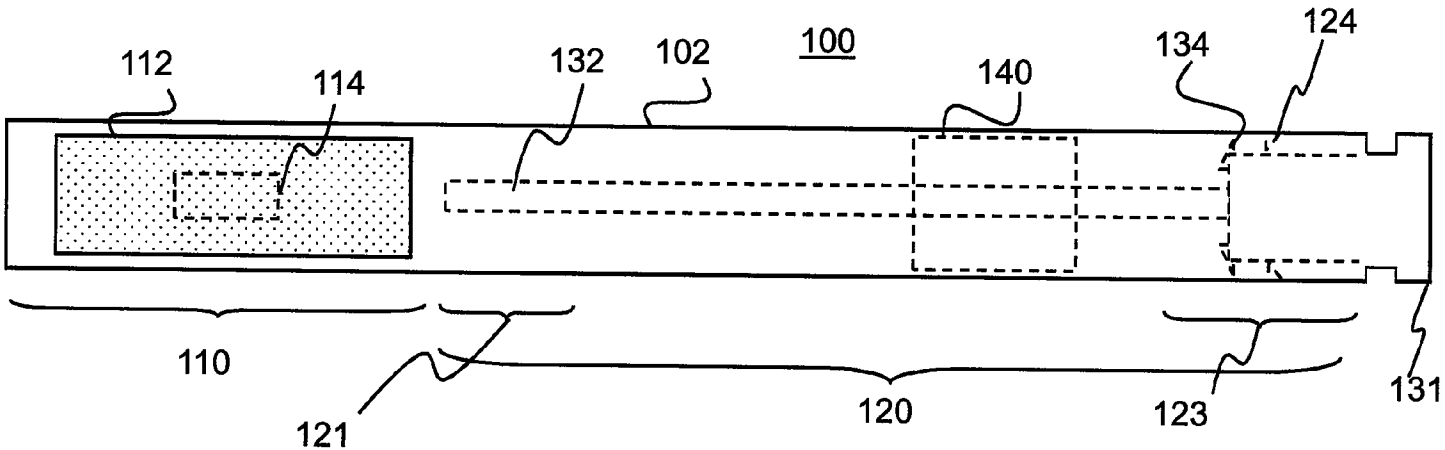
FIG. 6 is a top view of the tool of FIG. 1.
Figure 7:
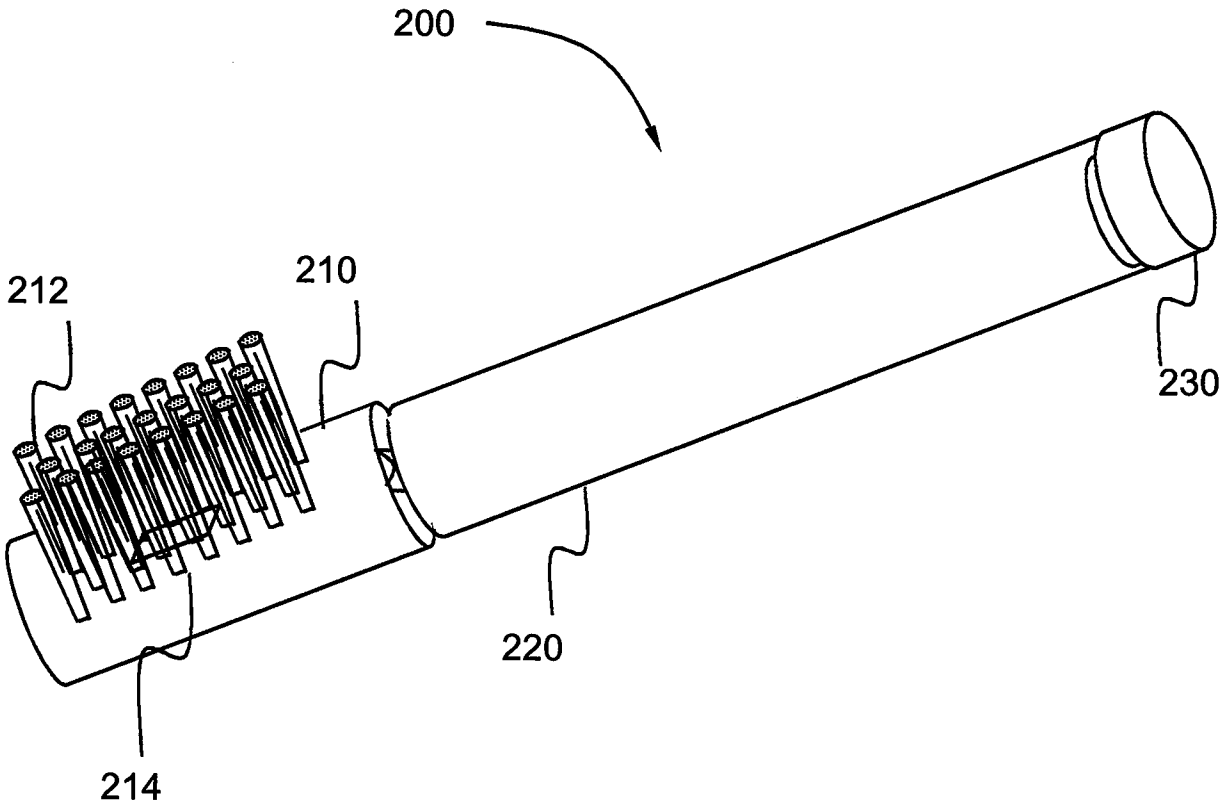
FIG. 7 is a perspective view of an oral hygiene tool according to another aspect of the present invention.
Figure 8:
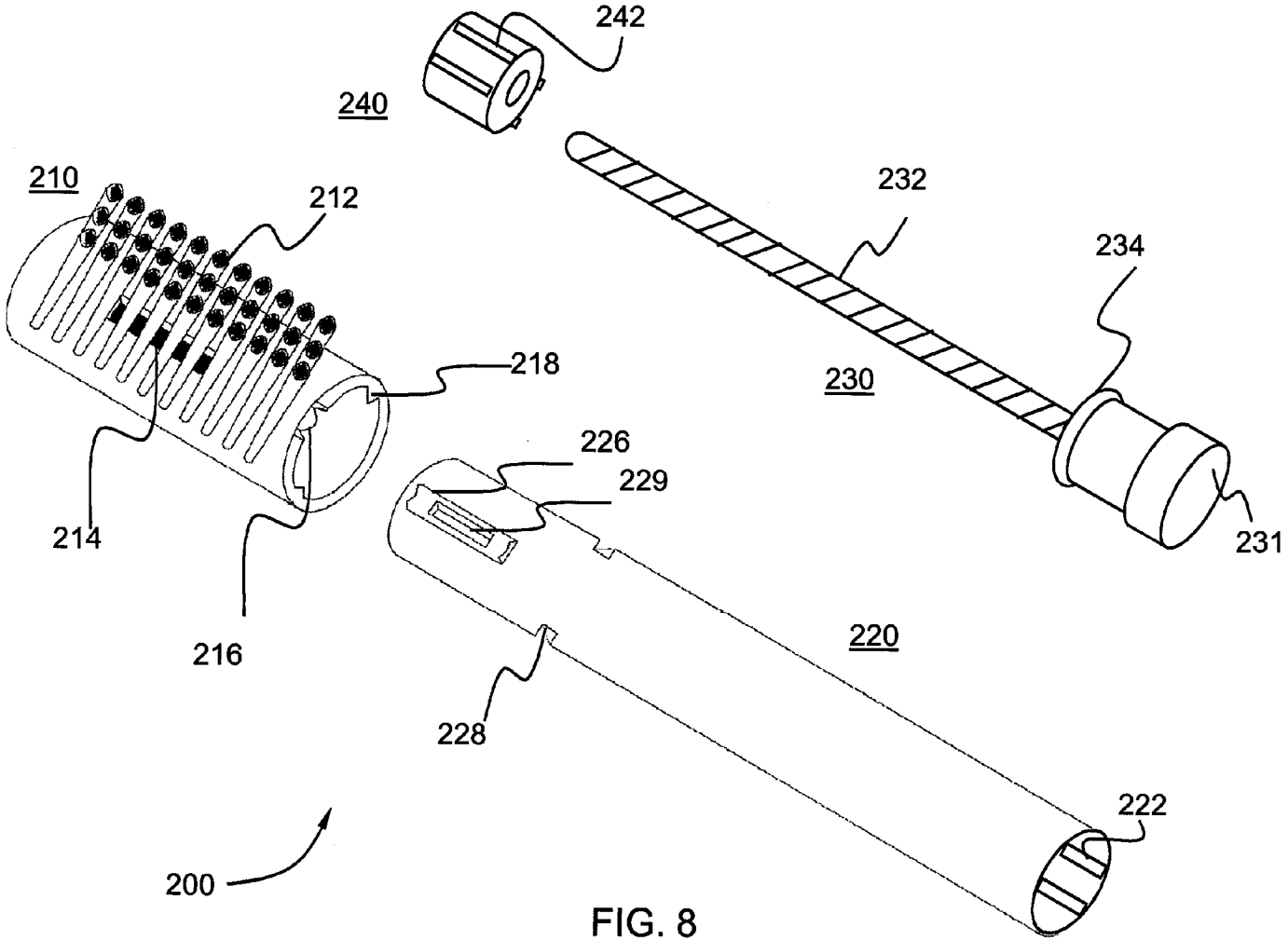
FIG. 8 is a perspective view of the tool of FIG. 7, with a brush section of the tool removed from a main body tube, and an end cap partially removed from the main body tube.
Figure 9:
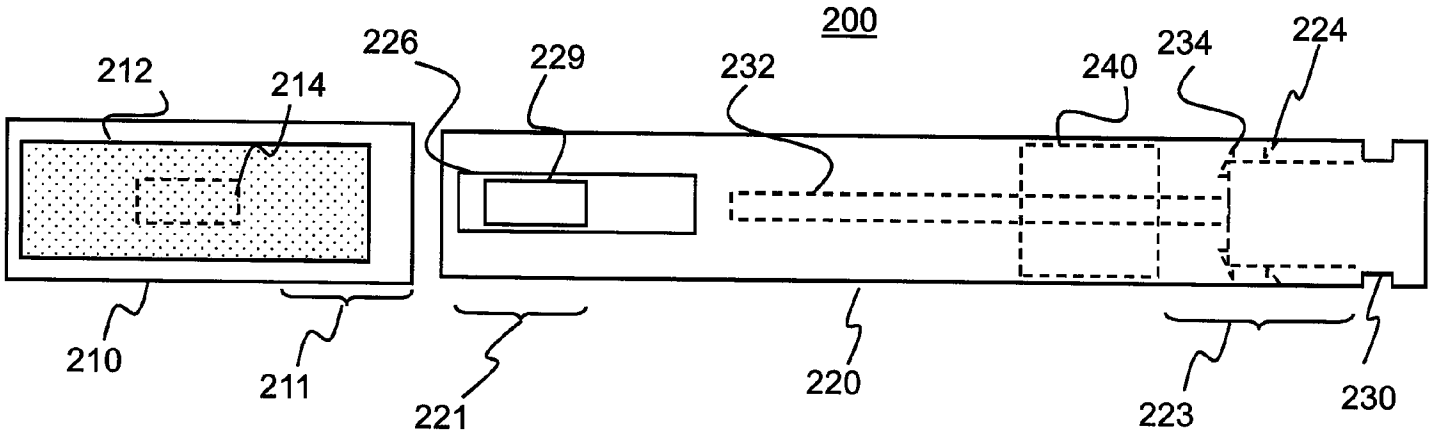
FIG. 9 is a top view of the tool of FIG. 7.

In the embodiment of FIG. 5, the first locking means 124 is a wedge shaped protrusion from the inner wall 125 spanning at least a portion of the circumference of the main body tube 120. The end cap 130 is assembled with the main body tube 120 by click fitting the second locking means 134 with the first locking means 124, as also illustrated by FIG. 6. The second locking means 134 may have a shape of, for example, a protrusion, as illustrated by the figures. According to the illustrated embodiments, the second locking means 134 locks into the main body tube 120 by click fitting with the first locking means 124, thereby coupling the end cap 130 with the main body tube 120. In the coupled configuration, the threaded pole 132 is configured to be positioned substantially in the center of the main body tube 120. Further, the turn cap 131 is configured to cause the bob 140 to move along the threaded pole 132 on turning the cap 131 in a clockwise or counterclockwise manner. This movement of the bob 140 is illustrated by the dotted bob 140 in FIG. 3.

Figure 13:
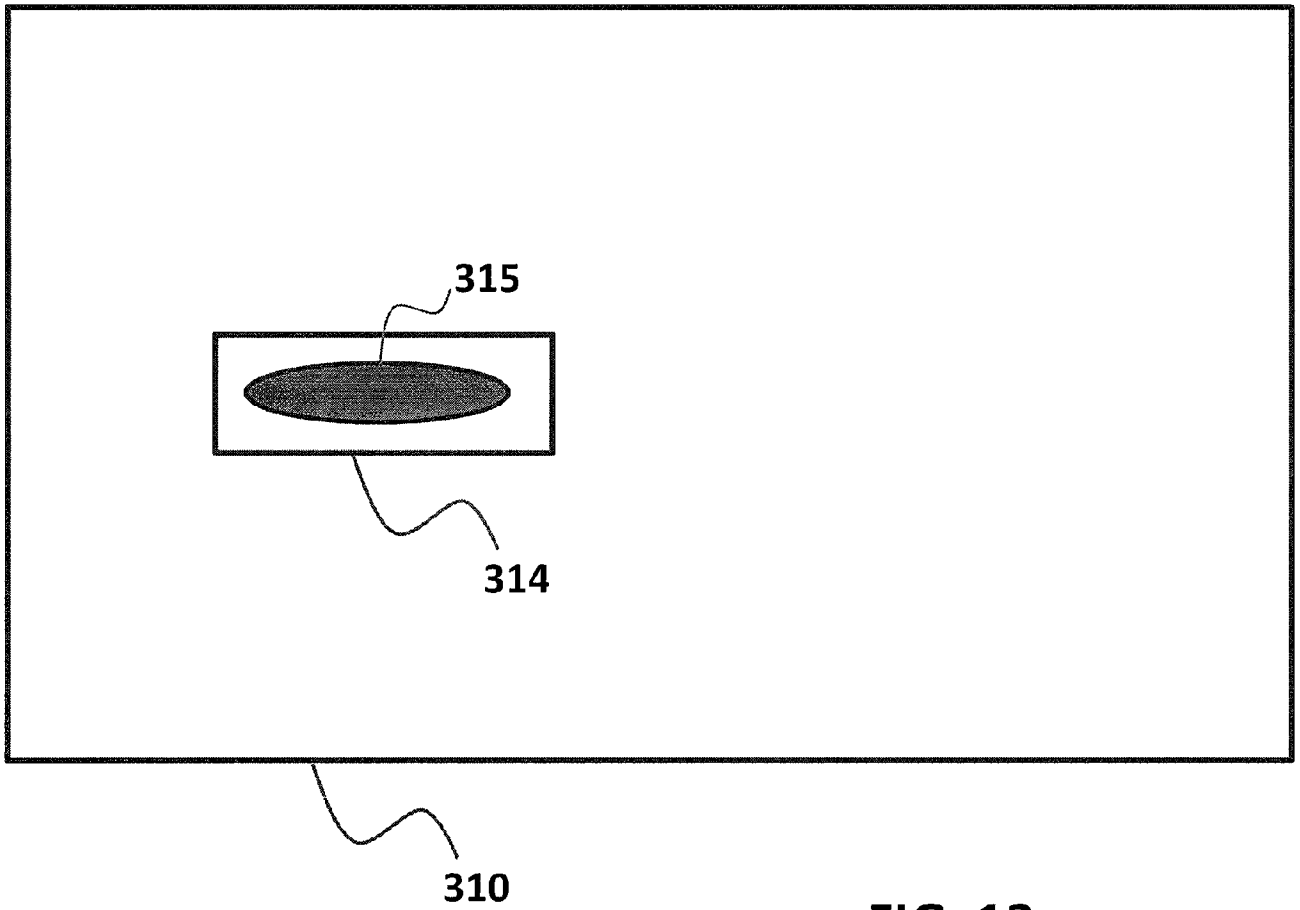
FIG. 13 shows the use of a baffle.

The main body tube 120 is configured to store a dentifrice, according to various embodiments of the present invention. The movement of the bob 140 away from the proximal end 123 of the main body tube 120 causes a dentifrice to be released from the first opening 114. The opening 114 may comprise a flexible or a non-flexible baffle to distribute the dentifrice among the bristles 112. FIG. 13 shows a baffle (conceptual) 315 for distributing the dentifrice among the bristles (not shown). Also shown are brush section 310 and first opening 312.

Figure 11:
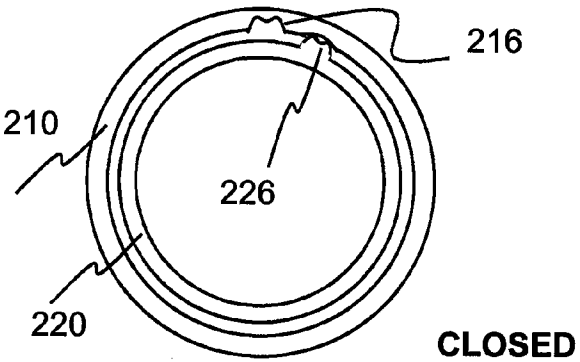
FIG. 11 is a cross section view of the tool of FIG. 7 in a "CLOSED" configuration.
Figure 10:
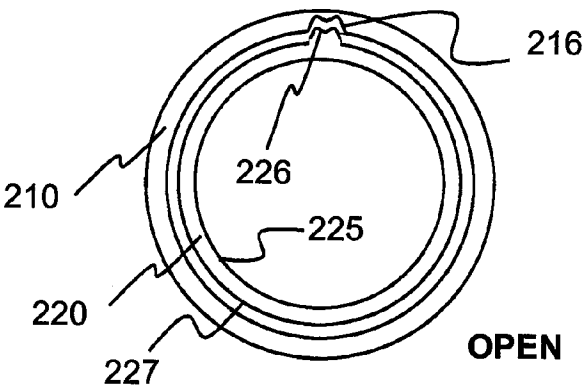
FIG. 10 is a cross section view of the tool of FIG. 7 in an "OPEN" configuration.

FIGS. 7 to 11 illustrate an oral hygiene tool, for example, a toothbrush 200, in accordance with certain aspects of the present invention. The toothbrush 200 includes a brush section 210, a main body tube 220, an end cap 230 and an internally threaded bob 240 (shown in FIG. 9). The brush section 210 has multiple bristles 212 and a first opening 214, for example, similar to the embodiment of FIGS. 1 to 6. Further, the brush cap 210 has an open brush proximal end 211 and the brush section 210 includes a first opening alignment means 216, for example a protrusion, and a first mating means 218, for example, a protrusion. The main body tube 220 has an inner wall 225, an outer wall 227, an open proximal end 223, an open distal end 221 and a first locking means 224. The main body tube 220 further comprises a second opening alignment means 226, for example an indentation, a second mating means 228, for example an indentation and a second opening 229 positioned on the main body tube 220, for example, in the distal end 221. The second opening alignment means 226 is configured to align with the first opening alignment means 216. The second mating means 228 is configured to mate with the first mating means 218 to integrate the brush section 210 and the main body 220 in a locking configuration. When the first opening alignment means 216 is aligned with the second opening alignment means 226, the second opening 229 coincides substantially with the first opening 214, thereby making a pass through window, for example, for releasing a dentifrice. This configuration is an "OPEN" configuration of the toothbrush 200, for example as illustrated in FIG. 10. When the first opening alignment means 216 is not aligned with the second opening alignment means 226, the second opening 229 does not coincide with the first opening 214, thereby blocking the second opening 229. This configuration is a "CLOSED" configuration of the toothbrush 200, for example as illustrated in FIG. 11. The "OPEN" and "CLOSED" configurations are enabled by the brush section 210 being movable with respect to the main body tube 220 to a configuration in which the first opening does not coincide with the second opening. This is possible, for example, in the embodiments illustrated in the figures, by turning the brush section 210 with respect to the main body tube such that the first and second opening alignment means 216 226 are not aligned (FIG. 11). The end cap 230 includes a threaded pole 232 and a turn cap 231 rigidly coupled to the threaded pole 232. A second locking means 234 is positioned on the turn cap 231. The second locking means 234 is configured to mate with the first locking means 224 to provide a locking configuration. An internally threaded bob 240 is configured to mate with the threaded pole 232. The bob 240 has a shape configured to fit within the main body tube 220. Further, in certain embodiments as also illustrated by the figures, the main body tube 220 has one or more rails 222 and the bob 240 has one or more conformal mating means 242 to mate with the rails 222. The rails 222 are configured to guide the movement of the bob 240 within the main body tube 220.

The main body tube 220 is configured to store a dentifrice, according to various embodiments of the present invention. In the "OPEN" configuration of the toothbrush 200, the movement of the bob 240 away from the proximal end 223 of the main body tube 220 causes a dentifrice to pass through the second opening 229 and to be released through the first opening 214. The opening 214 may comprise a flexible or a non-flexible baffle (not shown) to distribute the dentifrice among the bristles 212.

In certain embodiments, the toothbrush 100 or the toothbrush 200 is provided pre-loaded with an amount of dentifrice such as toothpaste, and is intended for a limited number of uses, for example, one or more uses, after which the toothbrush 100 or the toothbrush 200 may be discarded. In other embodiments, the toothbrush 100 or the toothbrush 200 may be loaded with a dentifrice, such as toothpaste, by the user, and are therefore reusable toothbrushes.

In one aspect, the present invention provides a method for making a toothbrush, for example a toothbrush 100. The method includes providing a tubular body, for example the tubular body 102 having a main body tube 120 and a brush section 110, and providing an end cap, for example the end cap 130. The brush section 110 of the tubular body has multiple bristles and a first opening, for example the opening 114. An open proximal end of the main body tube has first locking means that is locked with second locking means on the end cap, thereby coupling or locking the main body tube with the end cap. The end cap has a threaded pole mounted with a bob, and the initial position of the bob may be adjusted according to the amount of dentifrice intended to be loaded into the main body tube. A dentifrice may be supplied to the main body tube at any time before the complete assembly of the toothbrush, for example, from the proximal end of the main body tube, before the end cap is coupled. In configurations where the toothbrush is reusable, the end cap may be disengaged from the main body tube, a dentifrice may be loaded into the main body tube, and the end cap may be refitted to the main body tube as described earlier.

In another aspect, the present invention provides a method for making a toothbrush, for example, a toothbrush 200. The method includes providing a main body tube, a brush section, an end cap and a bob. A distal end of the main body tube has a second mating means into which a first mating means on a proximal end of the brush section is inserted, thereby coupling the main body tube with the brush section. Further, a proximal end of the main body tube has first locking means that is fitted with a second locking means on the end cap, thereby coupling the main body tube with the end cap. The end cap has a threaded pole mounted with the bob that is internally threaded, and the initial position of the bob is adjusted according to the amount of dentifrice intended to be loaded into the main body tube. The dentifrice may be supplied to the main body tube at any time before the complete assembly of the toothbrush, that is, from the proximal end of the main body tube, before the end cap is coupled to the main body tube, or from the distal end of the main body tube before the brush section is coupled to the main body tube. For example, after the assembly of the main body tube 220 and the end cap 230, a dentifrice may be loaded in to the main body tube 220 from the distal open end 221 of the main body tube 220. Alternately, the dentifrice may be loaded from the proximal end 223 of the main body tube 220 preceding the assembly of the main body tube 220 and the end cap 230.

In yet another aspect, the present invention provides a method for using an oral hygiene tool, such as toothbrushes as disclosed in accordance with various embodiments above. The method of using the toothbrush includes rotating a turn cap of the end cap, located at a proximal end of the toothbrush, and extruding at least some dentifrice, such as toothpaste, from an opening beneath multiple bristles of the toothbrush.

Those skilled in the art will appreciate that according to various embodiments, the oral hygiene tools as described herein, include a thermoplastic material that allows for a deformation of close surfaces. In the embodiment illustrated by FIG. 11, for example, the brush section is configured to be rotated with respect to the main body tube. It is illustrated that the brush section deforms (in most cases, temporarily), for example, in the transition from the open position to the closed position, or vice versa.

Further, it is appreciated that while the present invention has been described with respect to embodiments having a substantially circular cross section across the main body tube and the brush section, various aspects of the present invention are equally applicable to embodiments having a variety of cross sectional shapes, for example, rectangular, oblong, curved, and the like or a combination thereof. Further, it is noted that, for example, in an embodiment having substantially rectangular cross section main body tube, the bob will have a conformal rectangular shape and will not need rails or conformal mating means like grooves to cause the bob to move along the threaded pole on rotational movement of the end cap. All such obvious variations are included within the scope and spirit of the present invention, as also captured by the claims appended hereto.

The present invention provides for multiple advantages, in its various aspects. In one aspect, the invention provides for simple tools that are easy to use. In another aspect, the invention provides tools that are simple to manufacture or assemble, and easily dentifrice loadable tools. The simple tools made available by the present invention also provide a reduction in cost of manufacturing. According to some aspects, the present invention provides for disposable tools. In other aspects, the invention provides reusable tools.

Figure 12B:
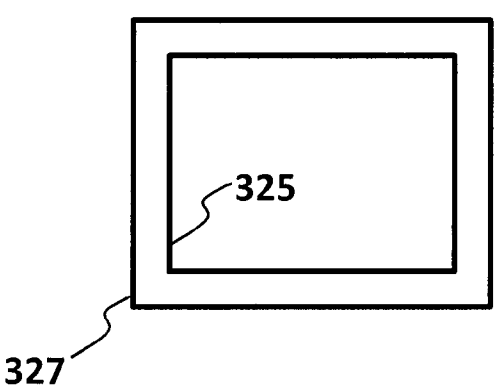
FIG. 12A, FIG. 12B and FIG. 12C show cross section views of main body tools with various cross-sectional shapes.
Figure 12A:
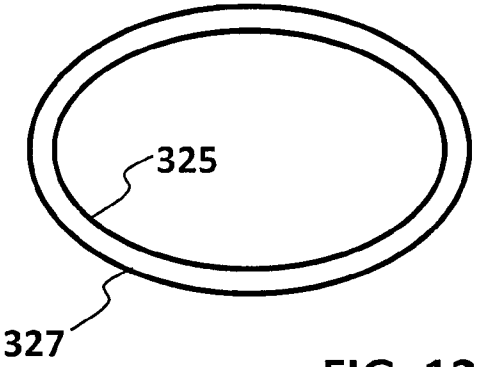
Figure 12C:
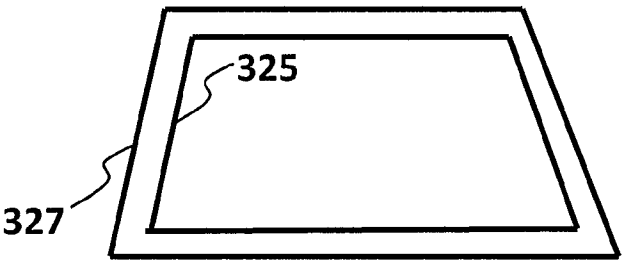

Although in the embodiments illustrated herein, the tubular body, the main body tube or the brush section have been described as having substantially circular cross sections, it is appreciated here that these components may readily be shaped to have cross sections having others shapes, including, but not limited to, elliptical, trapezoidal, rectangular or combinations thereof, such as illustrated in FIG. 12 (with inner wall 325 and outer wall 327). It is further appreciated here, that certain embodiments, for example those having a rectangular cross section will need a bob with a similar cross section. Use of such cross section may eliminate the need for rails and conformal mating means as the edges of the cross section will guide the bob within the main body tube. These and other such variations will occur readily to those skilled in the art, and all such obvious variations are included within the scope and spirit of the present invention as captured by the claims appended hereto.

It is further appreciated that the engagements, mating or coupling as described herein using locking means, mating means, rails and the like are obvious variations of various configurations known in the art, including but not limited to, protrusions or projections, indentations of various shapes and sizes, and all such mechanisms may be used interchangeably in the various embodiments described herein. Further, various "locking", "mating", "engaged" or "coupling" configurations as described herein, may be releasable configurations. Such obvious variations will readily occur to those skilled in the art and all such variations are also included within the scope and spirit of the present invention as captured by the claims appended hereto.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of the invention.

The invention claimed is:

1. An oral hygiene tool for dispensing a dentifrice, the tool comprising:

a tubular body comprising a main body tube having an inner wall and outer wall, the main body tube further comprising a distal end, a proximal open end and a first locking means, the main body tube forming a cavity for storing dentifrice, and a brush section having a plurality of bristles and a first opening situated to distribute dentifrice to the brushes, wherein the main body tube is disjoint from the brush section at the distal end, the brush section having an open brush proximal end and the main body tube having an open distal end, wherein the brush section further comprises a first opening alignment means;

a first mating means;

wherein the tubular body is configured for storing a dentifrice;

an end cap comprising a threaded pole;

a turn cap rigidly coupled to the threaded pole; and a second locking means associated with the turn cap, the second locking means configured to mate with the first locking means to provide a rotatable locking configuration there between, and an internally threaded bob configured to mate with the threaded pole, the bob having a shape configured to fit within the main body tube, wherein the end cap is configured to be assembled with the tubular body by locking the first and the second locking means, and wherein turning the turn cap causes the bob to move in a direction along the threaded pole, wherein the main body tube further comprises a second opening alignment means configured to reversibly align with the first opening alignment means;

a second mating means configured to mate with the first mating means to integrate the brush section and the main body in a locking configuration; and a second opening positioned on the main body tube such that when the first opening alignment means is aligned with the second opening alignment means, the second opening coincides substantially with the first opening, wherein the brush section is movable with respect to the main body tube to a configuration in which the first opening does not coincide with the second opening, wherein the movement of the bob away from the proximal end of the main body tube does not cause a dentifrice to be released from the first opening, if the second opening does not coincide with the first opening.

2. The tool of claim 1, wherein the movement of the bob away from the proximal end of the main body tube causes a dentifrice to be released from the first opening.

3. The tool of claim 1, where the inner wall of the main body tube comprises at least one rail and the bob comprises at least one conformal mating means configured to mate with the rail.

4. The tool of claim 1, wherein the main body cross section is a shape such that the bob, which has shape configured to fit within the main body tube, does not rotate with the main body tube when caused to move by turning the end cap.

5. The tool of claim 4, wherein the main body has an elliptical cross section.

6. The tool of claim 4, wherein the main body has a cross section having a shape selected from the group of a rectangle, a trapezoid or an ellipse or a combination thereof.

7. The tool of claim 1, wherein the first brush section comprises a flexible baffle for distributing dentifrice from the first opening among the bristles.

8. The tool of claim 1, wherein the movement of the bob away from the proximal end of the main body tube causes a dentifrice to be released from the first opening, if the second opening coincides substantially with the first opening.

9. A method of assembling an oral hygiene tool, the method comprising:

providing the oral hygiene tool of claim 1;

mounting the bob onto the threaded pole;

locking the first locking means with the second locking means to assemble the end cap with the main body tube; and locking the first mating means with the second mating means to assemble the brush section with the main body tube.

10. The method of claim 9 further comprising loading a dentifrice into the main body tube from the open proximal end.

11. The method of claim 9 further comprising loading a dentifrice into the main body tube from the open distal end.

12. The oral hygiene tool of claim 1, wherein the dentifrice cavity is of uniform cross-section from near the proximal end of the main body tube to the second opening.

* * * * *